US006397564B1

(12) United States Patent
Yamamoto

(10) Patent No.: US 6,397,564 B1
(45) Date of Patent: Jun. 4, 2002

(54) METHOD OF INSERTING BOOKLET INTO CASE AND APPARATUS FOR INSERTING SAME

(75) Inventor: Kaoru Yamamoto, Kyoto (JP)

(73) Assignee: Kyoto Seisakusho Co., Ltd., Kyoto (JP)

( * ) Notice: Subject to any disclaimer, the term of this patent is extended or adjusted under 35 U.S.C. 154(b) by 0 days.

(21) Appl. No.: 09/611,456

(22) Filed: Jul. 7, 2000

(30) Foreign Application Priority Data

Mar. 31, 2000 (JP) ..... 12-096121

(51) Int. Cl.[7] ..... B65B 5/10
(52) U.S. Cl. ..... 53/473; 53/157; 53/244
(58) Field of Search ..... 53/474, 238, 240, 53/457, 562, 445, 155, 473

(56) References Cited

U.S. PATENT DOCUMENTS 4,201,027 A 5/1980 Ilsemann
4,685,277 A * 8/1987 Ilsemann ..... 53/474
4,934,895 A * 6/1990 Smith ..... 53/381
5,207,050 A 5/1993 Fulkerson et al.
5,285,620 A 2/1994 Kaye et al.
5,664,405 A * 9/1997 Perego ..... 53/457
5,816,028 A 10/1998 Zaniboni
5,943,845 A 8/1999 Ilsemann
6,032,435 A * 3/2000 Zaniboni ..... 53/117
6,048,158 A 4/2000 Zaniboni

FOREIGN PATENT DOCUMENTS

JP 2001-48118 2/2001

* cited by examiner

*Primary Examiner*—Rinaldi I. Rada
*Assistant Examiner*—Gloria R. Weeks
(74) *Attorney, Agent, or Firm*—W. F. Fasse; W. G. Fasse

(57) ABSTRACT

A booklet inserting machine (1) includes a suction cup (3) for holding and unloading a booklet (B) on the top of a stack of booklets at a stacking station (2), a gripping device (4) to grip the booklet (B) unloaded by the suction cup (3), and a transferring device to transfer the gripping device (4) along with the gripped booklet (B) toward a case (10) to insert the booklet (B) into an engagement claw (14) of the case (10).

7 Claims, 8 Drawing Sheets

METHOD OF INSERTING BOOKLET INTO CASE AND APPARATUS FOR INSERTING SAME

BACKGROUND OF THE INVENTION

The present invention relates to the field of automated packaging, and more specifically, to a method of or an apparatus for inserting a booklet such as a description into a plastic case for an optical disk such as CD (i.e. Compact Disk), DVD (i.e. Digital Video Disk) or the like.

A case for an optical disk generally has an openable case body. An optical disk is loaded into one side of the case body and a booklet is inserted into the other side of the case body. On the front face of the case body is provided a cover for inserting a title sheet.

Conventionally, as there were no automated packaging machines to load an optical disk and insert a title sheet and a booklet into a case, these loading and inserting steps were carried out by hand, which was very troublesome.

The solution to this problem is identified in Onishi, Japanese patent application No. 11-217277, published on Feb. 20, 2001 as JP 2001-48118A. As shown in Onishi, an automated optical disk loading machine is provided where loading of an optical disk and insertion of a title sheet and a booklet can be automatically conducted.

In operation, as a case conveyor conveys a plurality of cases, an optical disk loading device loads an optical disk into a case, a title sheet inserting device inserts a title sheet into the insertion space of the case, and a booklet inserting device inserts a booklet into an engagement claw of the case.

The booklet inserting device is comprised of a suction cup to hold a booklet and a transferring mechanism to transfer the suction cup. At the time of insertion of a booklet, the suction cup holds a booklet on the top of the stacked booklets at the stacking station. In this condition, the suction cup is transferred to the case by the transferring mechanism and a booklet held by the suction cup is inserted into the claw of the case.

In a recent case for an optical disk, a booklet tends to contain more pages and to be thick. In the aforementioned machine, however, a booklet is held by only a suction cup while a booklet is transferred from the stacking station to the case.

Thus, though a booklet of thin thickness can be held by a suction cup, a booklet of thicker thickness cannot be held by the suction cup. As shown in FIG. 8, when a booklet has more pages with a thicker thickness, a page 111 held by the suction cup 100 buckles due to the weight of the remaining pages 110 that cannot be held by the suction cup 100. As a result, such a booklet cannot be securely inserted into the engagement claw of a case.

The main object of the present invention is to securely insert a booklet into an engagement claw of a case.

SUMMARY OF THE INVENTION

The present invention is directed to a method of or an apparatus for inserting a booklet into an engagement claw of a case.

The method of inserting a booklet includes the steps comprising:

(i) holding a booklet by suction and unloading the booklet from a stacking station having a plurality of booklets stacked therein or thereon;

(ii) gripping the booklet unloaded from the stacking station; and (iii) transferring the gripped booklet to the case and inserting the booklet into the claw of the case.

Preferably, the engagement claw is pushed up at the time of inserting a booklet into the claw.

The apparatus for inserting a booklet includes a suction cup to hold a booklet and unload it from a stacking station having a plurality of booklets stacked therein or thereon, and a gripping device to grip the booklet unloaded by the suction cup. The apparatus also includes a transferring device for transferring the gripping device along with the booklet gripped by the gripping device toward the case to insert the booklet into the claw of the case.

Preferably, the gripping device is comprised of a base on which a booklet is placed, and a cylinder to sandwich a booklet between the base and the cylinder.

The apparatus may include a push-up member adapted to push up the claw at the time of insertion of a booklet.

In a booklet insertion method of the present invention, first, a booklet stacked at the stacking station is held by suction and unloaded from the stacking station. The unloaded booklet is gripped and in this condition, the gripped booklet is transferred to the case and is inserted into the engagement claw of the case.

According to this method, a booklet held by suction and unloaded from the stacking station is gripped. Consequently, even when a booklet has more pages with a thicker thickness, the whole pages of the booklet are securely held and are transferred to the engagement claw of a case. Thereby, a booklet will not buckle at the time of transfer, and a booklet can be securely inserted into the engagement claw of a case.

In operation of a booklet insertion apparatus of the present invention, first, a booklet stacked at the stacking station is held by the suction cup and unloaded from the stacking station. The unloaded booklet is gripped by the gripping device. Then, the gripping device is transferred to the case and a booklet gripped by the gripping device is inserted into the engagement claw of a case.

According to this apparatus, a booklet held by suction cup and unloaded from the stacking station is gripped by the gripping device. Consequently, even when a booklet is a thicker one, the whole booklet is securely held and transferred to the engagement claw of a case and inserted thereinto.

BRIEF DESCRIPTION OF THE DRAWINGS

For a more complete understanding of the invention, reference should be made to the embodiments illustrated in greater detail in the accompanying drawings and described below by way of examples of the invention. In the drawings, which are not to scale.

DETAILED DESCRIPTION OF THE PREFERRED EMBODIMENTS

Figure 5:
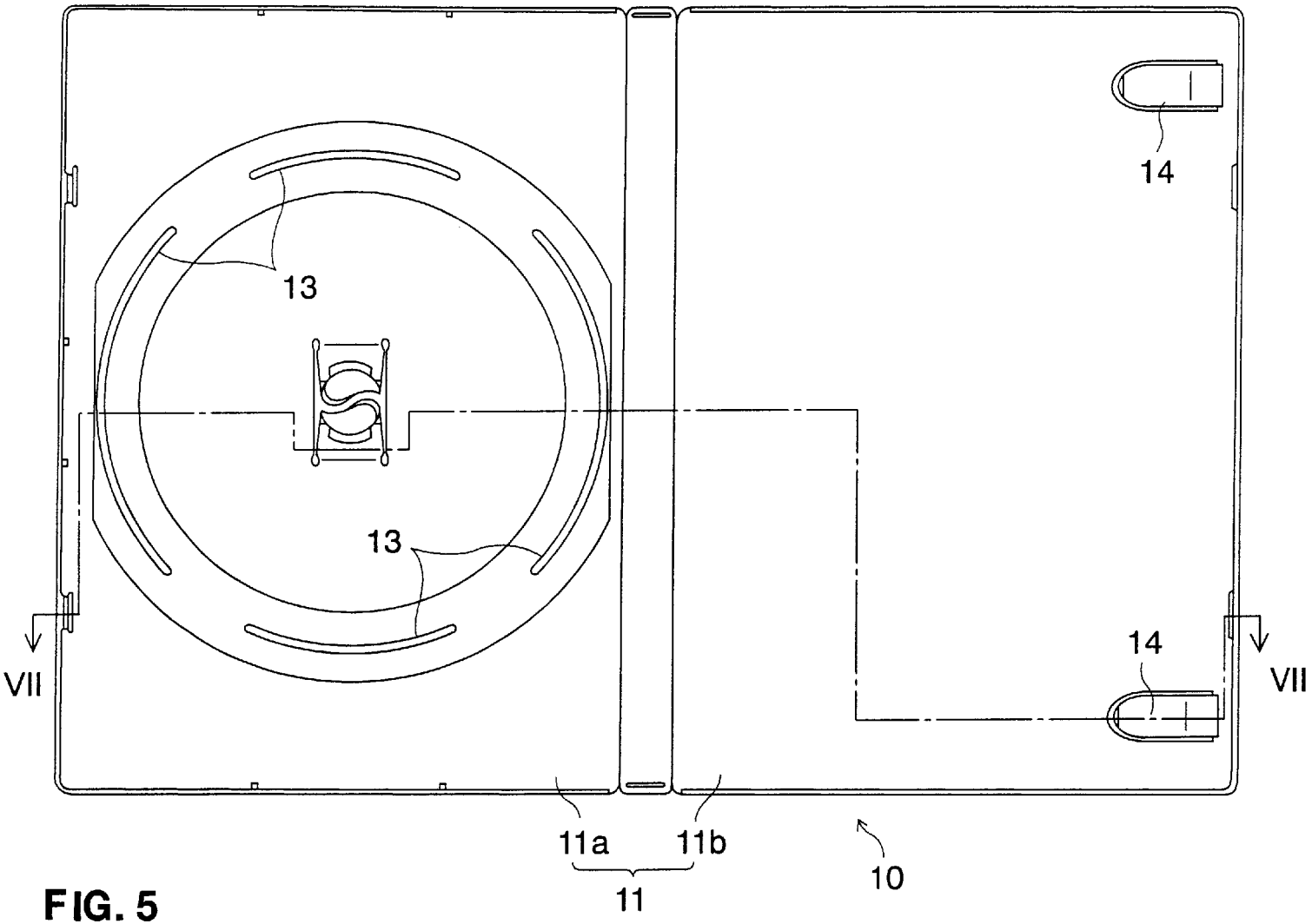
FIG. 5 is a top plan view of a case in the developed condition.
Figure 6:
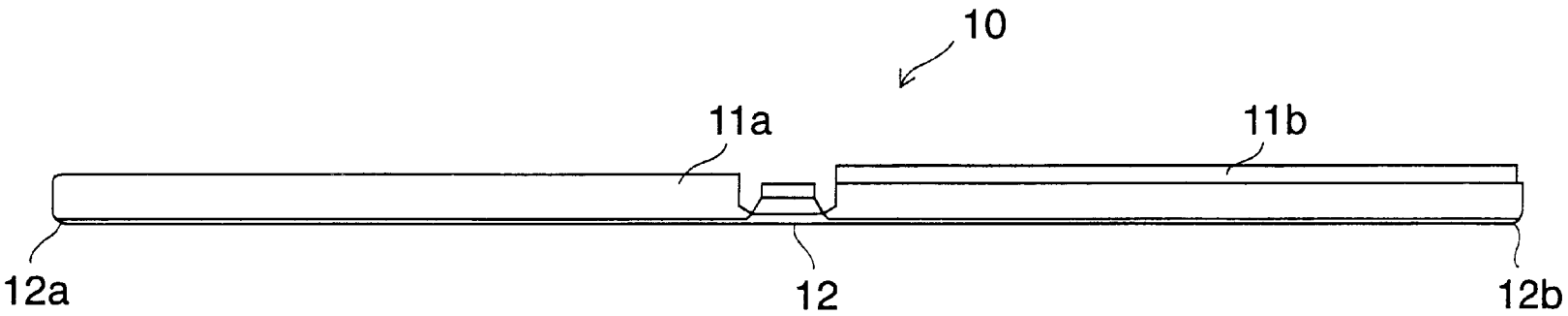
FIG. 6 is a side view of a case in the developed condition.
Figure 7:
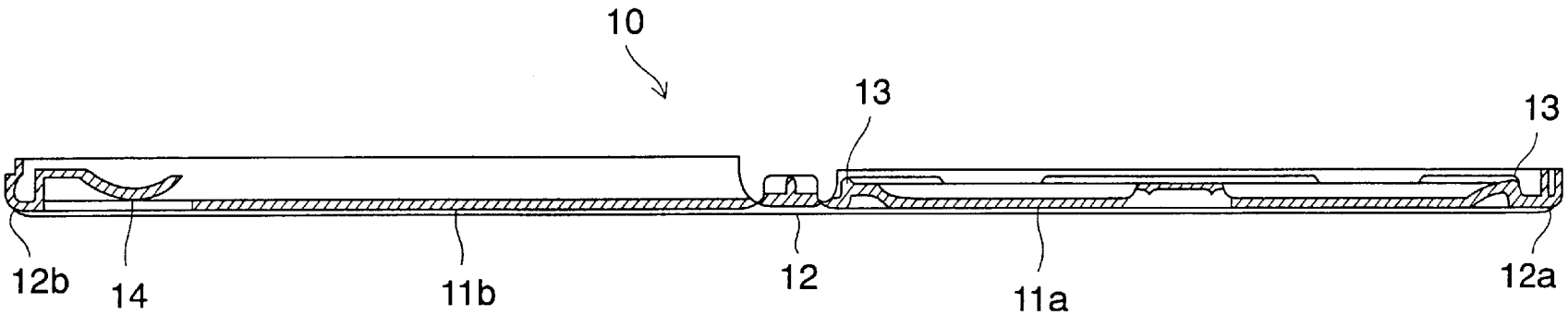
FIG.7 is a cross sectional view of FIG. 5 taken along line VII—VII.
Figure 8:
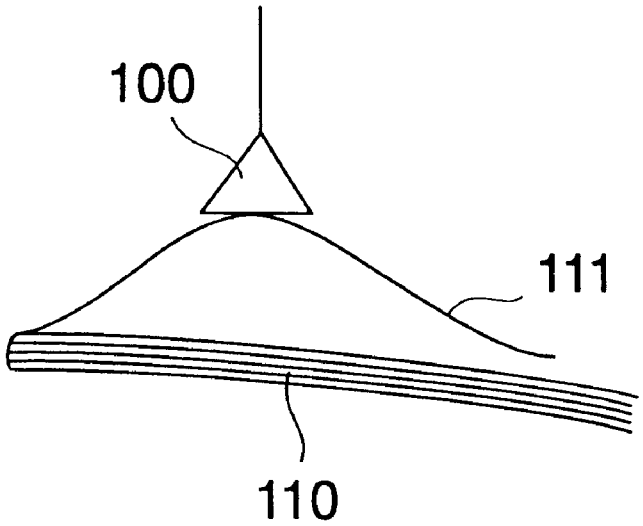
FIG. 8 PRIOR ART
FIG. 8 is a schematic illustrating a buckling condition of a booklet when it is held by only a suction cup.

Referring now to the drawings, FIGS. 5–7 illustrate a case to which a booklet insertion method of one embodiment of the present invention is applied.

As shown in FIGS. 5–7, a case 10 has a foldable or openable, box-shaped case body 11 and a cover 12 provided on the front side of the case body 11. On one side 11*a* of the case body 11 are formed a plurality of ridge portions 13 extending circumferentially. These ridge portions 13 form a loading hole for an optical disk (not shown). On the other side 11*b* of the case body 11 are provided a pair of engagement claws 14 to hold a booklet for the optical disk. Each of the claws 14 has a curved cross section, shown in FIG. 7. Both ends 12*a* and 12*b* of the cover 12 are heat-sealed to the end portions of the front side of the case body 11.

As shown in FIGS. 1–4, a booklet inserting machine 1 comprises a suction cup 3 holding by suction a booklet B on top of the stacked booklets at the stacking station 2 and unloading the booklet B from the stacking station 2, and a gripping device 4 to grip the unloaded booklet B.

Figure 1:
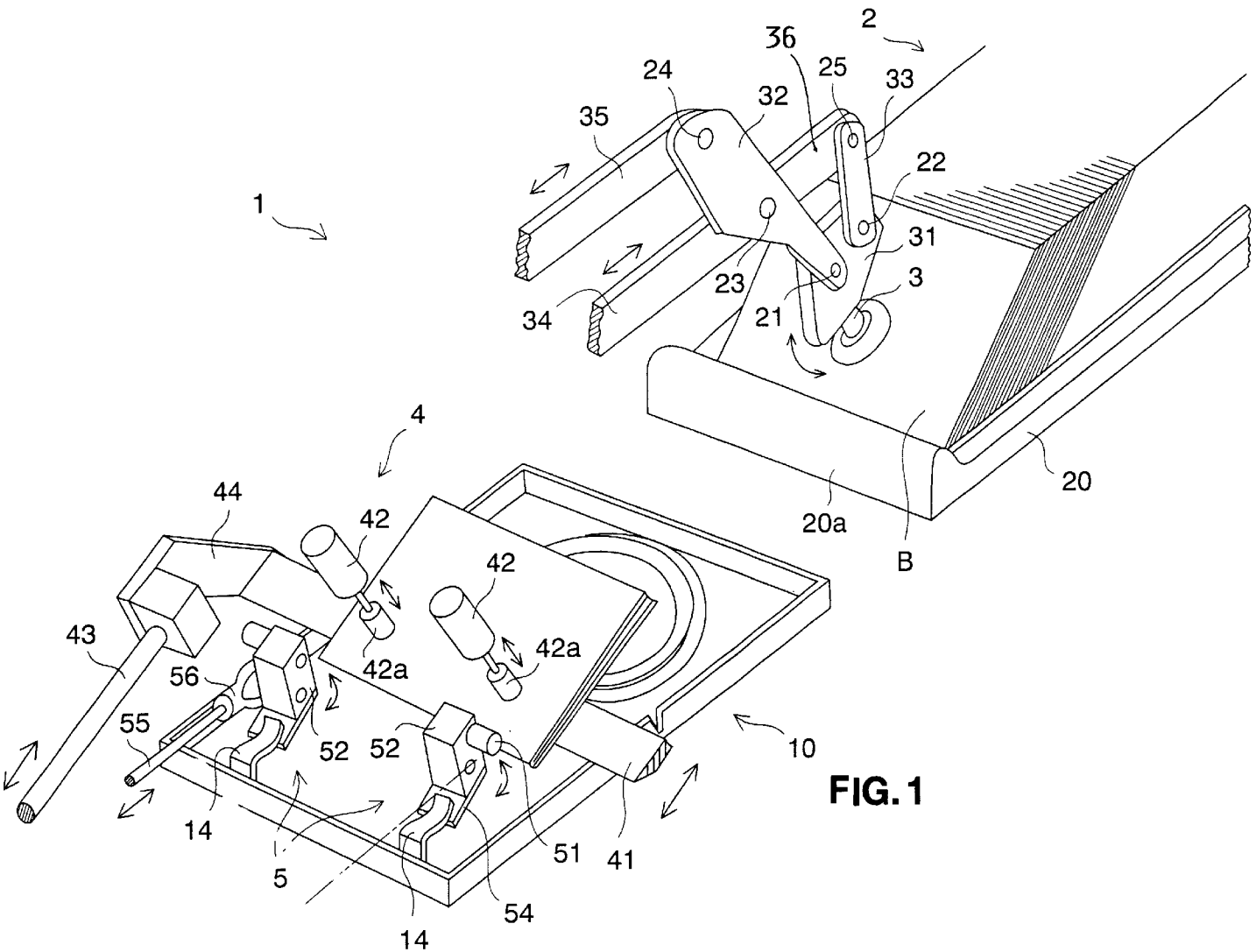
FIG. 1 is a perspective view of a booklet inserting machine of one embodiment of the present invention.
Figure 2:
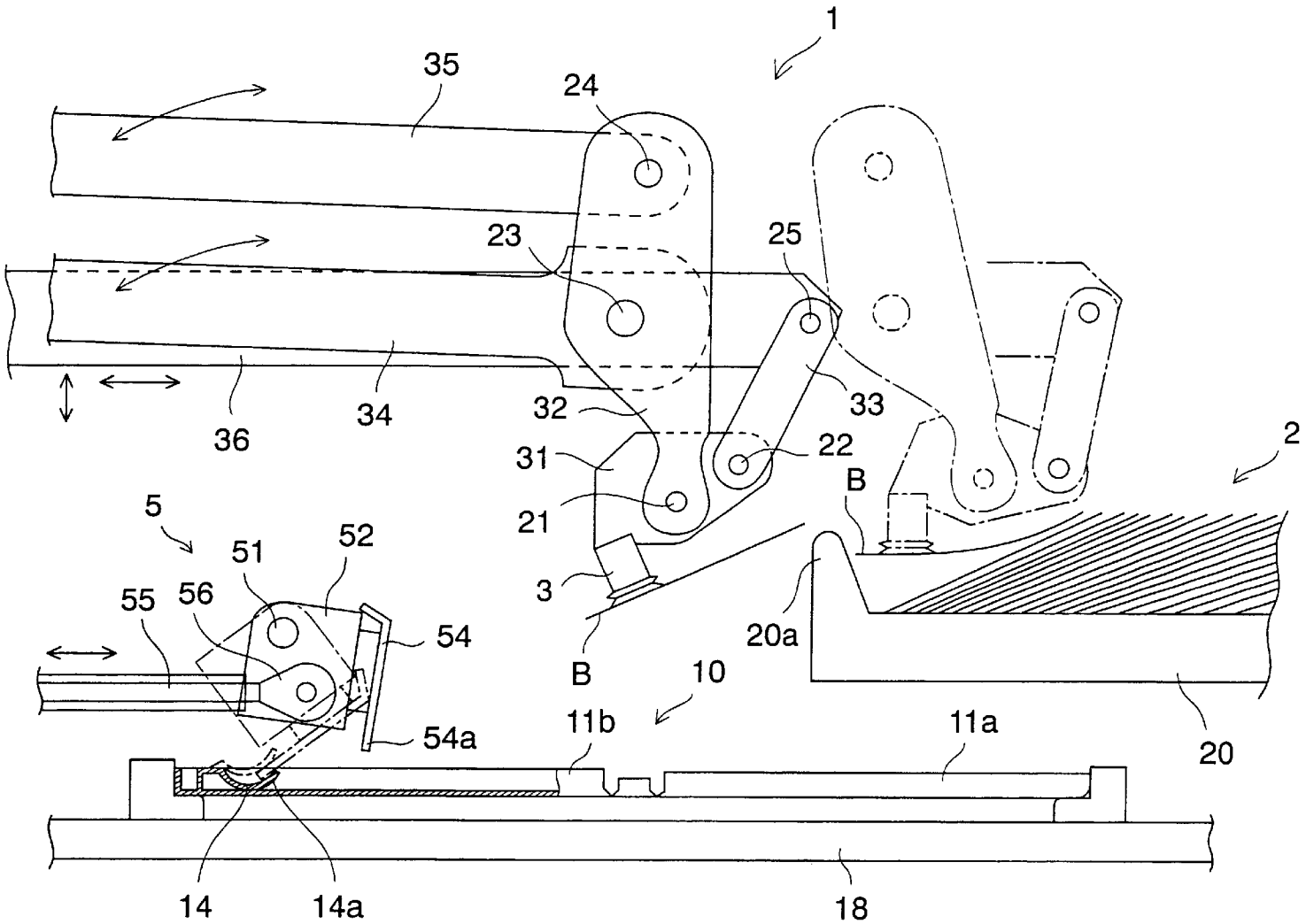
FIG. 2 is a schematic illustrating a suction cup and its driving mechanism of the booklet inserting machine of FIG. 1.
Figure 4:
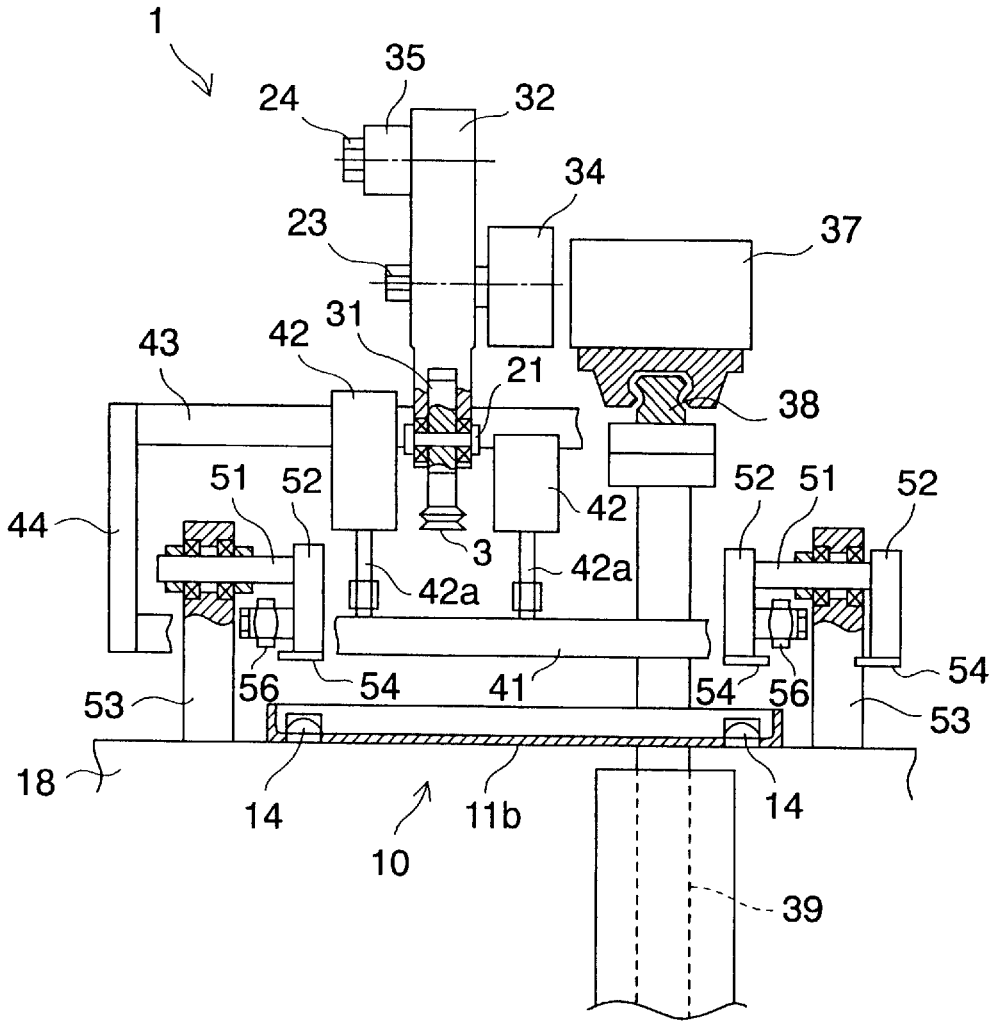
FIG. 4 is a cutaway side schematic view of the booklet inserting machine of FIG. 2.

The stacking station 2 includes a base 20 having a multiple of booklets thereon, and a stopper 20*a* provided at the end of the base 20. The suction cup 3, shown in FIGS. 1, 2, and 4, is fitted on a link 31. Each one end of links 32 and 33 is connected to the link 31 through pins 21 and 22, respectively. Laterally extending rods 34 and 35 are provided, and each distal end of the rods 34, 35 is connected to the link 32 through pins 23 and 24, respectively. The other end of the link 33 is connected with the distal end of a laterally extending rod 36 through a pin 25.

The other ends of the rods 34, 35 are connected to a lever (not shown). By this driving mechanism, the rods 34, 35 can travel in the arrow mark direction of FIGS. 1 and 2. The other end of the rod 36 is linked to the slide member 37 (FIG. 4) slidable on the rail 38, which extends horizontally and is connected to the upper end of the rod 39 movable in the vertical direction. The rod 36 can travel in the horizontal and vertical directions, shown in the arrow marks of FIG. 2.

Figure 3:
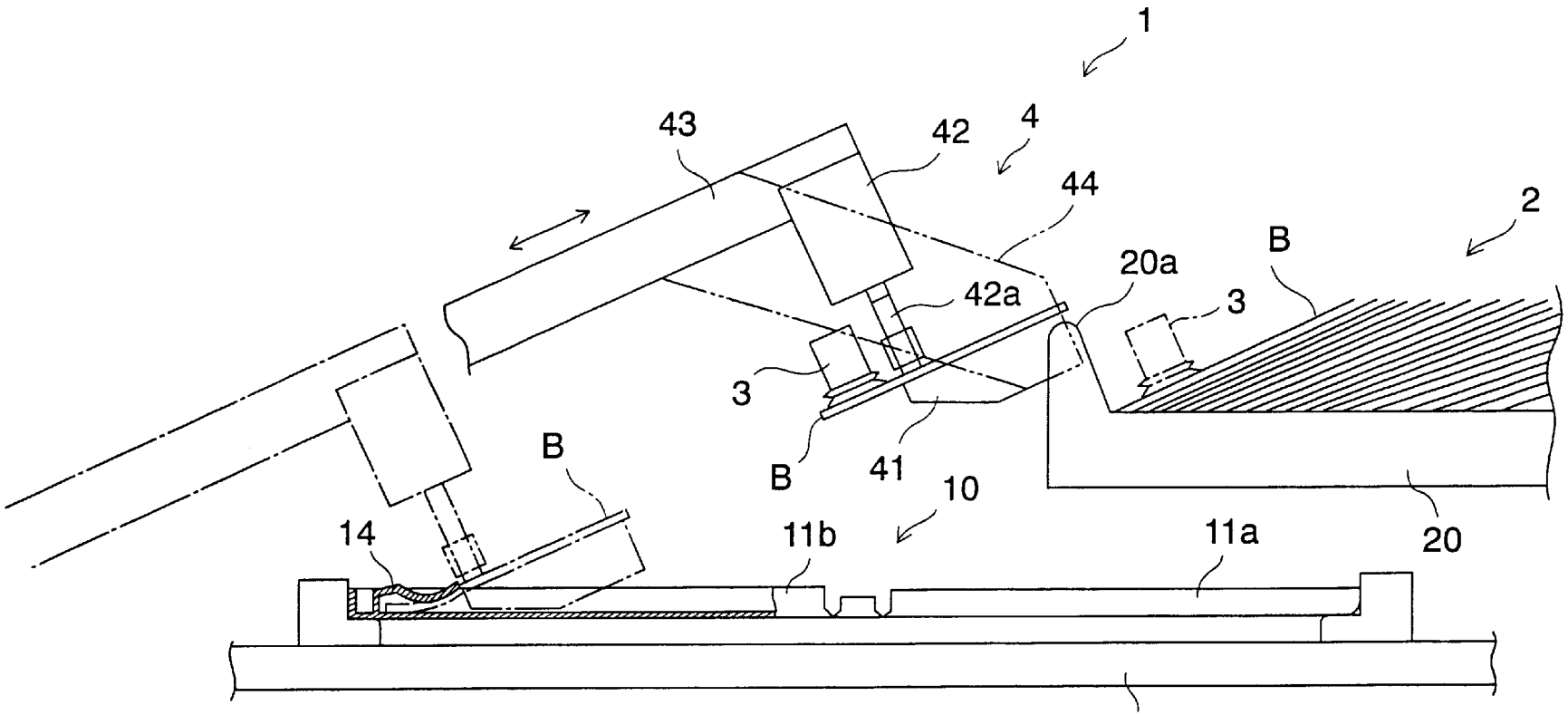
FIG. 3 is a schematic illustrating a gripping device of the booklet inserting machine of FIG. 2.

The gripping device 4, shown in FIGS. 1, 3 and 4, includes a base plate 41 on which a booklet B is placed, and a cylinder 42 to pinch or sandwich a booklet B between a piston rod 42*a* and the base plate 41. The cylinder 42 is provided on both sides of the suction cup 3, respectively.

Each cylinder 42 is fixed to the bar 43. The bar 43 is linked to the base plate 41 through the connecting plate 44. The other end of the bar 43 is connected to the cam plate (not shown), which is engaged with a lever (not shown) to drive the cam plate. The bar 43 and the base plate 41 along with the cylinder 42 can reciprocate in the arrow mark direction of FIGS. 1 and 3.

As shown in FIGS. 1, 2 and 4, a push-up mechanism 5 is provided to push up an engagement claw 14 of a case 10 placed on the table 18 in a developed condition. The push-up mechanism 5 has a rotatable plate 52 to which one end of a pin 51 is fixed. The pin 51 is received rotatably in a bracket 53 on the table 18. The rotatable plate 52 is rotatable or swingable around the center line of the pin 51. A contact plate 54, which is adapted to contact with the engagement claw 14 of a case 10, is fitted to the rotatable plate 52. The rotatable plate 52 is connected with the end 56 of a laterally movable connecting rod 55.

Now, the booklet inserting method by the aforementioned booklet inserting machine will be described hereinafter.

First, the cylinder 42 and the base plate 41 of the gripping device 4 are placed before the base 20, shown in FIG. 3. Then, by moving the rods 34, 35 and 36, the suction cup 3 travels toward the base 20 and holds the booklet B on top of the stacked booklets at the base 20, shown in FIG. 1 and the dashed line of FIG. 2.

In this condition, by moving the rods 34, 35 and 36 in the opposite direction to the above movement, the booklet B held by the suction cup 3 travels over the stopper 20*a* to the position in front of the base 20, shown in the solid line of FIG. 2. Thus, the booklet B is unloaded from the stacking station 2.

At this time, the booklet B held by the suction cup 3 is placed on the base plate 41 that has been standing by before the base 20. Then, the piston rod 42*a* protrudes by driving the cylinder 42, which causes the booklet B on the base plate 41 to be sandwiched or pinched between the piston rod 42*a* and the base plate 41, shown in FIGS. 1 and 3.

Then, by moving the gripping device 4, the cylinder 42 and the base plate 41 are transferred to the case 10, shown in FIG. 1 and the dashed line of FIG. 3. At this time, by driving the push-up mechanism 5, the rotatable plate 52 rotates around the center line of the pin 51 and the tip end 54*a* of the contact plate 54 contacts with the tip end of the engagement claw 14 of a case 10. Thereby, the engagement claw 14 is pushed up, shown in FIG. 1 and the dashed line of FIG. 2. Thus, a certain clearance is formed between the engagement claw 14 and the bottom face of the side 11*b* of the case body 11. As a result, at the time of insertion of the booklet B, the booklet B can be smoothly inserted into the engagement claw 14 because the end of the booklet B will not interfere with the engagement claw 14, shown in the dashed line of FIG. 3.

According to this embodiment, the booklet B, which is held by the suction cup 3 and unloaded from the stacking station 2, is gripped by the gripping device 4. Thus, even when a booklet has more pages of a thicker thickness, with the whole pages of the booklet securely gripped by the gripping device, the booklet is transferred to the case. Thereby, a booklet can be securely inserted into the engagement claw of a case without causing buckling during transfer.

Those skilled in the art to which the invention pertains may make modifications and other embodiments employing the principles of this invention without departing from its spirit or essential characteristics particularly upon considering the foregoing teachings. The described embodiments and examples are to be considered in all respects only an illustrative and not restrictive. The scope of the invention is, therefore, indicated by the appended claims rather than by the foregoing description. Consequently, while the invention has been described with reference to particular embodiments and examples, modifications of structure, sequence, materials and the like would be apparent to those skilled in the art, yet fall within the scope of the invention.

What is claimed is:

1. A method of inserting a booklet into an engagement claw of a case, comprising:

holding a booklet by suction and unloading said booklet from a stacking station having a plurality of booklets stacked at said stacking station;

gripping said booklet that has been unloaded from said stacking station;

transferring said booklet that has been gripped, to said case and inserting said booklet into said claw of said case; and pushing up said claw before and at the time of said inserting of said booklet into said claw.

2. The method according to claim 1, wherein said gripping of said booklet comprises mechanically gripping said booklet between a base plate and a selectively actuatable mechanical gripper member.

3. The method according to claim 1, wherein said pushing up of said claw comprises inserting a plate member under said claw and then pivoting and pulling up said plate member to push up said claw.

4. An apparatus for inserting a booklet into an engagement claw of a case, comprising:

a stacking station adapted to have a plurality of booklets stacked at said stacking station;

a suction cup adapted to hold and unload from said stacking station a respective booklet of said plurality of booklets;

a gripping device adapted to grip said booklet that has been held and unloaded by said suction cup;

a transferring device adapted to transfer said gripping device along with said booklet being gripped by said gripping device toward said case to insert said booklet into said claw of said case; and a push-up member adapted to push up said claw at the time of insertion of said booklet into said claw of said case.

5. The apparatus according to claim 4, wherein said gripping device comprises a base plate adapted to have said booklet placed thereon, and at least one piston-cylinder device adapted to mechanically grip said booklet between said base plate and said piston-cylinder device.

6. The apparatus according to claim 5, wherein said at least one piston-cylinder device includes two piston-cylinder devices spaced apart from each other with a space therebetween for accommodating and allowing said suction cup to pass therebetween.

7. The apparatus according to claim 4, wherein said push-up member comprises a pivotable plate adapted to be inserted under said claw and pivoted and pulled upward so as to lift said claw upward.

* * * * *